United States Patent [19]

Rydin

[11] 4,177,735

[45] Dec. 11, 1979

[54] CAR IMPACT CUSHIONING AND COUPLER CENTERING ARRANGEMENT FOR RAILROAD TRACK BUMPING POSTS

[76] Inventor: Carl N. Rydin, 4S556 River Rd., Naperville, Ill. 60540

[21] Appl. No.: 901,497

[22] Filed: May 1, 1978

[51] Int. Cl.[2] ..... B61K 7/18

[52] U.S. Cl. ..... 104/254; 104/249; 267/30; 293/136; 293/154

[58] Field of Search ..... 104/249, 254, 255, 256; 293/132, 135, 136, 137, 154, 155; 267/22 A, 30

[56] References Cited

U.S. PATENT DOCUMENTS

| | | | |
|---|---|---|---|
| 1,104,332 | 7/1914 | Waugh | 104/254 |
| 1,387,561 | 8/1921 | Scott | 104/254 |
| 2,189,170 | 2/1940 | Gaussoin | 267/30 UX |
| 2,860,582 | 11/1958 | Hayes | 104/254 |
| 2,929,618 | 3/1960 | Hutchens | 267/30 |
| 3,294,254 | 12/1966 | DeMent | 104/245 X |
| 3,854,765 | 12/1974 | Church et al. | 293/136 |
| 3,856,615 | 12/1974 | Dreher | 293/136 X |

FOREIGN PATENT DOCUMENTS

| | | | |
|---|---|---|---|
| 2258181 | 5/1974 | Fed. Rep. of Germany | 293/135 |

*Primary Examiner*—Randolph A. Reese
*Attorney, Agent, or Firm*—McWilliams, Mann & Zummer

[57] ABSTRACT

A car impact shock absorbing and coupler centering device for use in connection with railroad track bumping posts, which device comprises a block shaped body formed of resiliently compressible material that is of parallelepiped configuration which is adapted to be mounted against a fixed abutment defined by the post at the level of the center line of draft. The resilient body extends transversely of the track and is formed with a longitudinal bore through which extends a leaf spring assembly that has its ends projecting to either side of the body and which is proportioned transversely of the body bore to engage the body bore upper and lower sides. The ends of the leaf spring assembly are each equipped with a follower plate structure between which and a fixed support on the bumping post a compression spring assembly is interposed. Carried by the leaf spring assembly is a centering device for centering the car coupler relative to the resilient body. Car impacts against the shock absorbing device are resisted by the resilient body and leaf spring resiliently deflecting in combination.

11 Claims, 6 Drawing Figures

CAR IMPACT CUSHIONING AND COUPLER CENTERING ARRANGEMENT FOR RAILROAD TRACK BUMPING POSTS

This invention relates to shock absorbing bumping posts employed in connection with railroad track to check the movement of a railroad car at or adjacent the end of a length of track, and more particularly, to shock absorbing attachments for application to rigid railroad track bumping posts.

Bumping posts have long been employed in connection with railroad track to halt movement of railroad cars at or adjacent the end of a length of track. Both rigid and cushioned post arrangements are well known in the prior art.

This invention is specifically concerned with the provision of a shock absorbing device adapted for application to rigid bumping posts to convert or adapt them for cushioning coupler impacts against the post. An example of one well known type of rigid bumping post to which the invention is specifically applicable is shown in U.S. Pat. No. 2,860,582, granted Nov. 18, 1958 to Brice E. Hayes. The Hayes patent discloses a coil spring cushioned type attachment for application to the rigid post disclosed in this patent.

The principal object of this invention is to provide a combination resilient block and leaf spring unit for bumping posts that combines the resiliencies of these two types of shock absorbers in one unit in a manner for ready application to conventional rigid bumping posts.

Another principal object of this invention is to provide, in an attachment arrangement for rigid bumping posts of the type disclosed in said Hayes patent, a combination of a block of rubber (or the like) and a leaf spring unit or assembly in which these two basic cushioning components are united in a manner to bring their separate shock absorbing capabilities into operative combination for providing improved bumping post shock absorbing characteristics.

Other objects of the invention are to provide a bumping post cushioning arrangement of few and simple parts, that is essentially maintenance free, and that is economical of manufacture, convenient to install, and long lived in use.

In accordance with the invention, the basic shock absorbing unit comprises a block or body of neoprene rubber or the like of generally parallelepiped configuration having a bore formed therethrough lengthwise thereof to receive a leaf spring assembly that is proportioned lengthwise thereof to have its ends project from either end of the block, and that is proportioned widthwise of same to engage the upper and lower portions of the body bore. The cushioning unit resilient body has a front side on one side of same parallelling the side faces of the leaf spring assembly that is the impact receiving face of the unit, and a rear side that is to seat against a rigid bearing seat provided by the post. The ends of the left spring assembly are separately connected to the post through individual cushioning assemblies. In the preferred form, the unit is equipped with coupler centering arms carried by the leaf spring assembly ends that center the coupler for direct impact against the combination cushioning unit, and specifically the front side of the resilient body of same.

In a preferred arrangement, the shock absorbing unit is incorporated in an attachment arrangement for application to rigid posts of the type disclosed in said Hayes patent, and in particular, to the existing fixed impact plate of such post. For this purpose, a bearing plate arrangement is provided on which the shock absorbing unit is mounted, and which includes an adapter section that is received over and secured to the post impact plate so that the shock absorbing unit is disposed at the level of the center line of draft. The individual cushioning assemblies at the ends of the leaf spring assembly each comprise a center rod anchored between the respective leaf spring assembly ends and the bearing plate, and an annular compression spring device through which the respective center rods extend. The center rods are connected to the bearing plate for swinging movement of their forward ends toward each other under the impact of a car coupler against the front side of the shock absorbing unit resilient body, with both the resilient body and the leaf spring assembly being deflected adjacent the mid lengths of same against the bearing plate under the impetus of the impact. Thus, the resilient body and the leaf spring assembly of the unit act in concert to cushion the impact with the center rods of the leaf spring end cushioning assemblies swinging toward each other to compress the indicated compression springs for supplementing the resistance of said body and leaf spring assembly to the impact.

Yet other objects uses, and advantages will be obvious or become apparent from a consideration of the following detailed description and the application drawings, in which like reference numerals are employed to indicate like parts throughout the several views.

Figure 1:
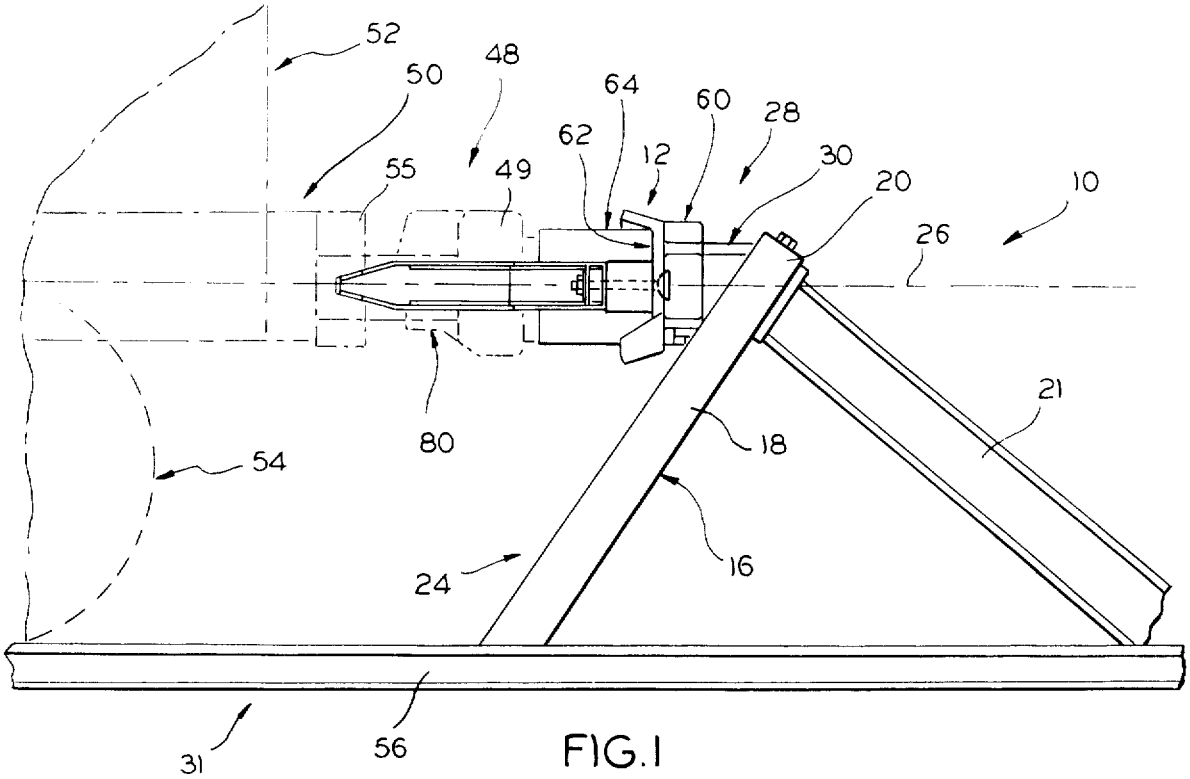
FIG. 1 is a side elevational view of the rigid bumping post of the type disclosed in said Hayes patent, shown equipped with a preferred embodiment of this invention; with a car illustrated in outline and shown impacting against the bumping post.

However, it is to be distinctly understood that the specific drawing illustrations provided are supplied primarily to comply with the requirements of the Patent Laws, and that the invention is susceptible of various modifications and variations that will be obvious to those skilled in the art, and that are intended to be covered by the appended claims.

Reference number 10 of FIGS. 1-4 generally indicates a rigid bumping post of the type disclosed in said Hayes patent that is equipped with the shock absorbing device 12 that is arranged in accordance with this invention, and that is adapted for application to the post 10.

The post 10 comprises the usual forward brace member 16 having legs 18 suitably anchored in the track bed and apex portion 20 suitably secured to the spaced rear brace members 21 and 22 that are also suitably anchored in the track bed and integrated with the brace member 16 to form rigid frame structure 24 that has affixed thereto at the elevation of the center line of draft 26 a rigid bumping post head 28 including neck structure 30 suitably affixed to the frame structure 24 and having affixed thereto and facing down the right of way of the track 31 the fixed impact or striking plate 32 that is generally planar in configuration and that defines forwardly facing impact face 34.

Figure 2:
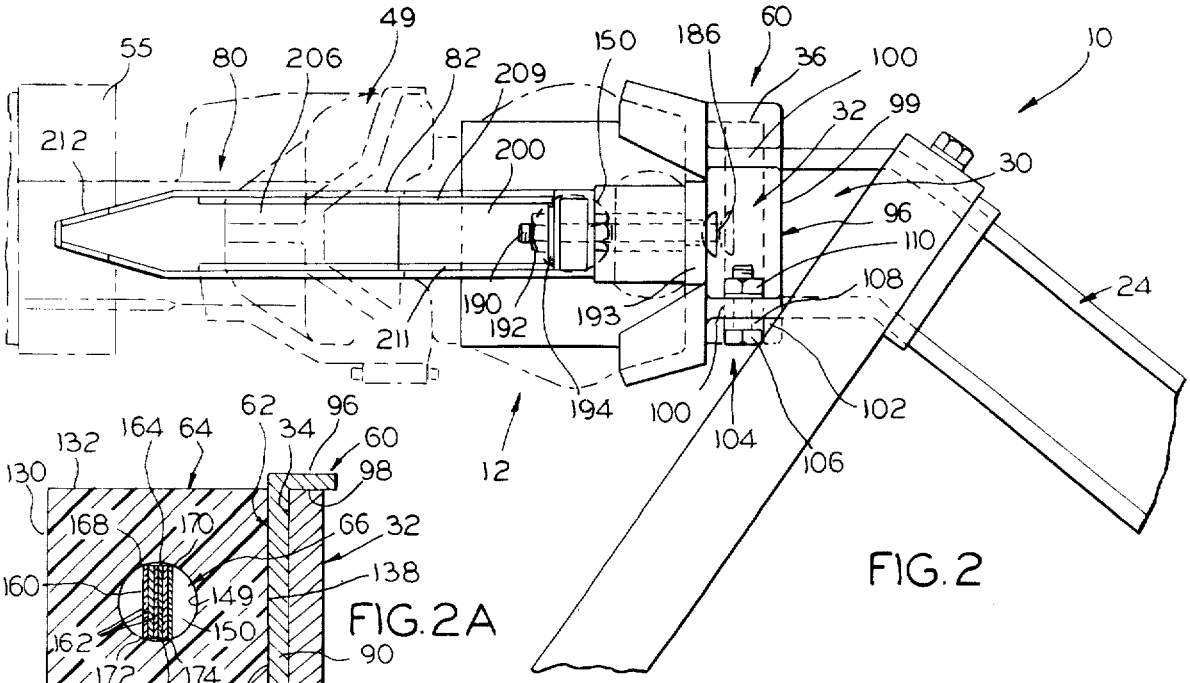
FIG. 2 is a fragmental view similar to that of FIG. 1 but illustrating only the upper portion of the bumping post and the shock absorbing attachment therefor arranged in accordance with this invention, with the car coupler and striker shown in outline form.
Figures 3, 4, 5:
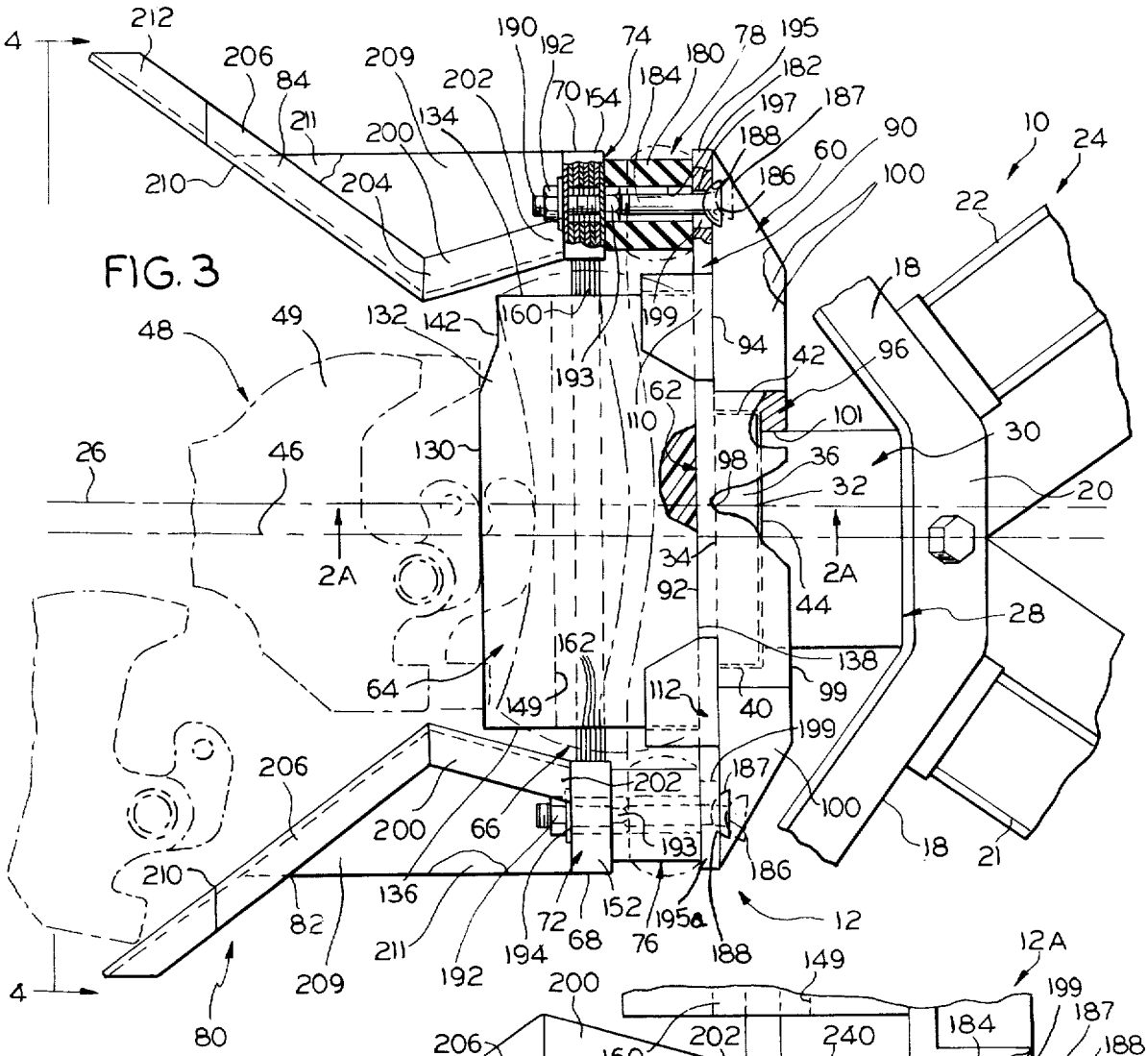
FIG. 3 is a plan view of the arrangement shown in FIG. 2, with parts being broken away to expose other parts, and with the coupler illustrated in several different positions as it moves into impact relation with the shock absorbing device of this invention.
FIG. 4 is a front elevational view of the bumping post and its shock absorbing device, taken substantially along line 4—4 of FIG. 3.
FIG. 5 is a fragmental plan view based on FIG. 3 showing one end of the shock absorbing device as modified to illustrate a modified form of the invention, with parts being shown in section.

As indicated in outline in FIGS. 2, 3 and 4, the plate 32 is generally rectangular in parallelepiped configuration defining, in addition to the face 34, top edge 36, bottom edge 38, and side edges 40 and 42 as well as rear face 44 that is suitably affixed to neck structure 30 in any convenient manner, as by welding. Following conventional practice, the bumping post 10 is offset laterally of the center line of draft 26 to have a center line located approximately where indicated by reference numeral 46 in FIG. 3 due to the configuration of conventional car couplers, one of which is indicated at 48 in the drawings suitably applied to center sill 50 of railroad car 52 riding on the usual wheels 54 that in turn ride on the familiar track rails 56 that make up the track 32, all as is well known in the art. Center sill is equipped with the usual striker 55.

The shock absorbing device 12 comprises a bearing plate structure 60 that is releasably secured to the bumping post impact back plate 32 and that is formed to define the planar bearing seat 62 against which is seated resilient cushioning body 64 that is operatively associated with leaf spring assembly 66 that at its ends 68 and 70 has applied thereto the respective follower assemblies 72 and 74 which have applied between same and the base plate structure 60 compression spring assemblies 76 and 78.

The leaf spring assembly 66 also mounts the coupler centering device 80 that in the form shown comprises a pair of oppositely disposed coupler centering arms 82 and 84 carried by the respective follower assemblies 72 and 74.

The bearing plate structure 60 generally comprises planar body portion 90 that is formed on its side 92 to define the planar bearing seat 62, and that on its side 94 is formed to define housing portion 96 shaped internally to define socket 98 proportioned to freely receive the impact plate 32, with the housing portion 96 being slotted on the rear side 99 of same to receive the neck structure 30.

The bearing plate structure 60 on its side 94 also includes suitable reinforcing flanging 100; the housing portion 96 along its open bottom side has suitable cap 102 applied to same held in place by suitable bolt and nut assemblies 104 on either side of the plate structure 60 that may comprise suitable bolt 106 extending through the cap lug 108 and an adjacent flange 100 to have suitable nut 110 applied thereto in the manner indicated in FIG. 2 (it being understood that the cap 102 is secured in place to the plate structure 60 in a similar manner on both sides of the device 12).

The bearing plate structure 60 at its four external corners 110, 112, 114 and 116 is formed with the respective corner lug structures 118, 120, 122 and 124 for locating the corner marginal portions of the bearing seat 61.

The block or body 64 is generally of parallelepiped configuration and is formed from neoprene rubber or the like to define the forward or striking face 130, top surface 132, side surfaces 134 and 136, rear or back surface 138 which is to be applied to seat 62, and bottom or lower surface 140. The front striking surface 130 may be indented as indicated in FIG. 3, where indicated at 142 to accommodate tight lock couplers as well as the standard type of coupler 48 that is illustrated in FIG. 3. Neoprene rubber (known generally as polychloroprene) is preferred, and that employed to make block 64 should have a durometer lying in the range of from about 60 to about 70.

The body 60 is thus made of durable resiliently compressible material to, under the force of the impact of the car 52 that is delivered to it by the car coupler 48, against its striking face 130, deflect in combination with the leaf spring assembly 66 to approximately the dashed line positioning illustrated by FIGS. 2 and 3 for 15 mile per hour impacts; the resilient deflection should provide a travel of approximately 8 inches in combination with leaf spring assembly 66 and 9 inches without it with the combination to provide approximately 600,000 pounds resistance for a 10 mile per hour impact.

Figure 2A:
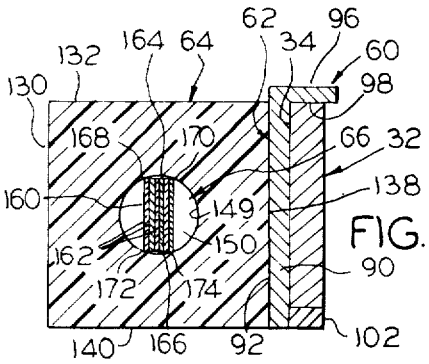
FIG. 2A is a fragmental vertical sectional view through the shock absorbing device and taken substantially along line 2A—2A of FIG. 3.

The body 64 is formed with internal cylindrical wall 149 forming bore 150 extending lengthwise thereof (and therethrough) and transversely of the track 32 to closely receive the leaf spring assembly 66 (see FIG. 2A).

The leaf spring assembly 66 comprises elongate leaf spring 160 made up of a plurality of abutting plates 162 formed from spring steel or the like in the usual leaf spring fashion, with the ends of the leaf spring assembly 74 including the follower structures 72 and 74 that comprise the respective sleeves 152 and 154 received over the respective leaf spring ends in close fitting relation thereto.

As indicated in the drawings, the leaf spring 160 is proportioned lengthwise of same and crosswise of the track 32 to have its ends project outwardly of the body bore 150 for application thereto of the respective sleeves 152 and 154. Leaf spring 160 is of quadrilateral transverse cross-sectional configuration, as indicated in FIG. 2A, and has its long dimension of such configuration proportioned so that its upper and lower sides 164 and 166 are in juxtaposed position with the correspondingly located portions of the body surface 149 for contact therewith, which are in engagement with same at edges 168, 170, 172 and 174.

The compression spring assemblies 76 and 78 each comprise a sleeve 180 formed from neoprene rubber or the like which are interposed between the front side 92 of the bearing plate 90 and the respective sleeves 152 and 154. The sleeves 180 thus each define the bore 182 through which extends a center bolt 184 that has its head 186 formed with spherically contoured bearing surface 187 seated against the correspondingly contoured annular bearing seat 188 formed in the bearing plate 90. The threaded ends 190 of the respective bolts 184 extend through the respective sleeves 152 and 154 and the leaf spring ends they embrace for application thereto of nut 192 that seats against washer 194 which in turn seats against the forwardly facing side of the respective sleeves 152 and 154. The rearwardly facing sides of the respective sleeves 152 and 154 seat against the respective nuts 193 of the bolts 184.

Sleeves 180 are preferably formed from neoprene rubber having a durometer in the same range as the material forming body 64.

The center bolts 184 are tensioned sufficiently to fully seat the body 64 and the sleeves 180 against bearing seat 62. The bolts 184 are applied to the bearing plate side extensions 195 and 195a that are each formed with the respective bolt openings 197 that are elongated as at 199 to permit the bolt threaded ends 190 to swing toward each other when the bumping post is impacted, as described hereinafter.

The centering arms 82 and 84 each comprise a base section 200 having its end 202 suitably affixed to the sleeve 152 or 154 that carries same, as by welding, and its other end 204 suitably fixed to guide member 206. Members 206 are disposed in diverging relation at equal angles off parallelism with the longitudinal center 46 of the bumping post 10; this angulation is preferably in the range of from about forty to about sixty degrees (fifty four degrees in the illustrated embodiment).

In the form shown, the members 200 and 206 are of channel shaped configuration, with the members 206 thus defining planar camming surfaces 210 that serve to cam the coupler head 49 from side swing positions, such that as suggested in FIG. 3, to a centered position with regard to the block 64, as the coupler moves toward and into impact relation with the body 64. The centering arms 82 and 84 are each reinforced by upper and lower stiffener plates 209 and 211 applied between their respective base sections 200 and guide members 206, as by employing welding.

As indicated in the drawings, the projecting ends 212 of members 206 are of tapered configuration to avoid interference with car components adjacent the coupler at the level of the center line of draft.

As will be observed in the drawings, the bearing plate structure 60, body 64, the leaf spring assembly 66, and the centering device 80 are at the level of the center line of draft 26, and are centered on the bumping post center line 46.

Assuming car 52 is moving toward post 10, as the coupler 48 moves into the range of centering device 80, the coupler head 49 is centered relative to device 12 by the coupler head engaging, to the extent it is in a side wing position, one or the other of the centering arms 82 and 84 (and specifically, the surface 210 of same), so that the coupler head will strike the forward face 130 of block or body 64 approximately as indicated in FIG. 3. Under the impetus of the impact, the body 64 deflects inwardly thereof and in turn deflects the leaf spring assembly 66 at its mid portion, until the body 66 achieves the approximate stressed configuration indicated in broken lines in FIGS. 2 and 3. As the body 64 moves towards this position, the spring assembly followers 72 and 74 are compressed against the resiliently compressible sleeves 180, with the forward ends of the center bolts 184 tending to swing toward each other as the leaf spring assembly 66 arcs in the direction of the bearing seat 61; the bolt openings 197 of the bearing plate through which the respective bolts 184 extends being slotted or elongated somewhat as indicated at 199, accommodate this action.

At the position of maximum deflection, body 64 assumes the general shaping indicated in dashed lines in FIGS. 2 and 3, center bolts 184 in this position tending to project somewhat from the rear of the bearing plate 60. The corner lugs 118, 120, 122, and 124 having the vertical angling indicated to accommodate the bulging action in the body 64 at its top and bottom side surfaces 132 and 140. The upper lugs 118 and 120 also resist tendencies of the impacting car to shift the body 64 upwardly. The sleeves 180 have a portion of the cushioning action involved, they tending to compress axially and bulge radially under the stress involved approximately as shown in outline in FIG. 3. Further, as the coupler engages either of the arms 82 or 84, in being centered as the car moves toward bumper 10, such arms 82 and 84 are individually initially cushioned by the respective sleeves 180.

When the impetus of the impact has been dissipated, the resiliency of the body 64 and sleeves 180 restore the parts to the initial position of FIGS. 2 and 3. The coupler 48, by the centering action of device 80, will have been centered for good recoupling position.

In the modified shock absorbing device 12A of FIG. 5, the components are the same except that the compression assemblies 76 and 78 are in the form shown in FIG. 5. The compression spring assembly 230 there shown comprises inner and outer coil springs 232 and 234 in coaxial relation about the respective swing bolts 184 and seated against the respective spring seats 236 and 238. Spring seat 236 is in turn seated against resilient disc 239; the respective leaf spring assembly sleeves 152A may be equipped with centering elements 240 and 242 for maintaining the compression spring assembly 230 centered at the leaf spring assembly end 68. Similarly, the base plate 60 may be equipped with a centering lip where indicated at 244.

In a specific embodiment of the invention, the body 64 is one foot square in transverse cross-sectional configuration and two feet in length (longitudinally of the leaf spring assembly 66. The leaf spring assembly is three feet, four inches long and comprises six one quarter inch spring steel sheets of good leaf spring quality which when combined togther in the usual leaf spring manner have a transverse crosss-sectional configuration of four and seven eighths inch by one and one half inch.

The sleeves 180 are five inches in outside diameter and five inches in length and their bores are two inches in internal diameter. The swing bolts 184 are ten inches in length and their shanks have an external diameter of one and one quarter inches. Sleeves 180 will compress two and one half to three inches in performing their shock absorbing functions.

The bore 150 of body 64 has an internal diameter of five inches to accommodate ready fitting of the leaf spring assembly therethrough with siding contact with the body 64 as indicated in FIG. 2A.

The body portion 90 of bearing plate structure 60 may be alternately arced concavely in vertical section so as to effect a wrapping of the body 64 around the striking end of the coupler, when impacts are occasioned, to provide improved centering action on the coupler.

Shock absorbing devices 12 also may be adapted for application to concrete bumping posts.

The foregoing description and the drawings are given merely to explain and illustrate the invention and the invention is not to be limited thereto, except insofar as the appended claims are so limited, since those skilled in the art who have the disclosure before them will be able to make modifications and variations therein without departing from the scope of the invention.

I claim:

1. A shock absorbing attachment for railroad track bumping posts of the type including a vertically disposed striking plate fixedly mounted above the track at the level of the car center line of draft adjacent the end of the track right of way for engagement by the car coupler, said attachment comprising:

a bearing plate having a forward side and a rearward side, means for mounting said bearing plate on the striking plate with the bearing plate forward side facing the track right of way and with said bearing plate extending crosswise of the track and being vertically disposed, said bearing plate forward side defining a seat, a body formed from resiliently compressible material and being of generally parallelepiped configuration defining a rear side seated on said bearing plate seat and a front side facing oppositely of said rear side, said body being formed to define a cross bore therethrough that parallels said front and rear sides of said body, a leaf spring positioned in said body bore and proportioned lengthwise thereto to have its ends extend externally of said body bore on either side of said body, said leaf spring having a rectangular transverse cross-sectional configuration and being disposed to have the long sides of its said configuration in substantial parallelism with said bearing plate and proportioned such that said leaf spring engages the upper and lower portions of said body bore, said leaf spring ends each having interposed between same and said bearing plate a compression spring assembly, said compression spring assemblies each comprising:

a center rod anchored between the respective leaf spring ends and said bearing plate and an annular compression spring through which the respective center rods extend, said center rods being disposed in substantial parallelism and projecting forwardly of said bearing plate bearing seat on either side of same, said center rods being connected to said bearing plate for swinging movement of their forward ends toward each other under the impact of a car coupler against the front side of said body to compress said body against said bearing seat with said leaf spring adjacent the mid length of same being deflected toward said bearing plate under such impact, whereby said body and said leaf spring act in combination to cushion said impact with said center rod forward portions swinging toward each other to compress said compression spring assemblies for supplementing the resistance of said body and said leaf spring to said impact.

2. The attachment set forth in claim 1 wherein:

said compression spring assemblies each further comprise:

a follower plate structure anchored to the respective leaf spring ends and bearing against the respective annular compression springs, said center rods of the respective compression spring assemblies being anchored to the respective follower plate structures adjacent the forward ends of same.

3. The attachment set forth in claim 2 wherein:

said leaf spring and said compression spring assemblies are disposed at the level of the center line of draft.

4. The attachment set forth in claim 3 wherein:

said follower plate structure carries guide arm means extending forwardly of said attachment at the level of the center line of draft for centering the car coupler on said body front side.

5. The attachment set forth in claim 4 wherein said guide arm means comprises:

a pair of arms disposed on either side of the center line of draft and having the forward ends of same angularly disposed relative to the center line of draft to cam the car coupler into centered impacting relation with said body.

6. The attachment set forth in claim 5 wherein:

said arms are respectively cantilever mounted in the respective follower plate structures.

7. The attachment set forth in claim 6 wherein:

said follower plate structures each comprise:

a tubular member embracing the leaf spring end to which the respective follower plate structures are respectively anchored, said center rods extending through the respective tubular members and the leaf spring ends embraced by same.

8. A shock absorbing bumper for a railroad track bumping post, said bumper comprising:

a body formed from resiliently compressible material and being of generally parallelepiped configuration defining a rear side adapted to be seated on said post and a front side facing oppositely of said rear side, said body being formed to define a cross bore therethrough that parallels said front and rear sides of said body, a leaf spring positioned in said body bore and proportioned lengthwise thereto to have its ends extend externally of said body bore on either side of said body, said leaf spring having a rectangular transverse cross-sectional configuration and being disposed to have the long sides of its said configuration disposed upright and proportioned such that said leaf spring engages the upper and lower portions of said body bore, said leaf spring ends each having interposed between same and said post a compression spring assembly, said compression spring assemblies each comprising:

a center rod anchored between the respective leaf spring ends and a bearing plate and an annular compression spring through which the respective center rods extend, said center rods being disposed in substantial parallelism and projecting forwardly of a bearing seat defined by said bearing plate on either side of same, whereby said body and said leaf spring act in combination to cushion coupler impacts against same.

9. The bumper set forth in claim 8 wherein:

said compression spring assemblies each further comprises:

a follower plate structure anchored to the respective leaf spring ends and bearing against the respective annular compression springs, said follower plate structure carrying guide arm means extending forwardly of said attachment at the level of the center line of draft for centering the car coupler on said body front side.

10. The bumper set forth in claim 9 wherein said guide arm means comprises:

a pair of arms disposed on either side of the body and having the forward ends of same angularly disposed relative to the center line of draft to cam the car coupler into centered impacting relation with said body.

11. The bumper set forth in claim 10 wherein:

said arms are respectively centilever mounted in the respective follower plate structures.

* * * * *